US010194230B2

(12) United States Patent
Kulavik et al.

(10) Patent No.: US 10,194,230 B2
(45) Date of Patent: Jan. 29, 2019

(54) EARPHONES WITH MOTION SENSITIVE INFLATION

(71) Applicant: Voyetra Turtle Beach, Inc., Valhalla, NY (US)

(72) Inventors: Richard Kulavik, San Jose, CA (US); Christopher Church, San Jose, CA (US)

(73) Assignee: VOYETRA TURTLE BEACH, INC., Valhalla, NY (US)

( * ) Notice: Subject to any disclaimer, the term of this patent is extended or adjusted under 35 U.S.C. 154(b) by 0 days.

(21) Appl. No.: 14/827,309

(22) Filed: Aug. 15, 2015

(65) Prior Publication Data

US 2016/0050483 A1 Feb. 18, 2016

Related U.S. Application Data

(60) Provisional application No. 62/037,847, filed on Aug. 15, 2014.

(51) Int. Cl.

| | |
|---|---|
| ***H04R 25/00*** | (2006.01) |
| ***H04R 1/10*** | (2006.01) |
| *H04R 29/00* | (2006.01) |

(52) U.S. Cl.

CPC ..... *H04R 1/1041* (2013.01); *H04R 1/1016* (2013.01); *H04R 1/1008* (2013.01);

(Continued)

(58) Field of Classification Search

CPC .. H04R 1/1016; H04R 25/656; H04R 25/652; H04R 1/10; H04R 25/65; H04R 2460/11; H04R 2225/025; A61F 11/10; A61F 11/00; A61F 2011/145; A61M 25/10181; Y10T 29/49005

(Continued)

(56) References Cited

U.S. PATENT DOCUMENTS

| | | | | |
|---|---|---|---|---|
| 6,094,494 A * | 7/2000 | Haroldson | ..... | H04R 25/456 381/322 |
| 8,526,651 B2 * | 9/2013 | Lafort | ..... | H04R 25/60 381/322 |
| 8,548,181 B2 * | 10/2013 | Kraemer | ..... | H04R 1/1016 381/150 |

(Continued)

FOREIGN PATENT DOCUMENTS

| | | | | |
|---|---|---|---|---|
| WO | WO 2012076061 A1 * | 6/2012 | ..... | H04R 1/1016 |

*Primary Examiner* — Phylesha Dabney

(74) *Attorney, Agent, or Firm* — McAndrews, Held & Malloy, Ltd.

(57) ABSTRACT

Methods and systems are provided for earphones with motion sensitive inflation. In an audio system that comprises an audio output element that is applied directly to or is in contact with at least a portion of an ear of a user of the audio system, one or more adjustments to positioning of the least portion of the audio output element relative to the ear of the user may be determined and applied. The one or more adjustments may be determined as to account for or counteract one or more conditions affecting the outputting of the audio signals and/or contact between the audio output element and the one ear of the user. The one or more adjustment may be applied by modifying characteristics of one or more positioning components of (or coupled to) the audio output element. The one or more positioning components comprise at least one inflation-based component.

22 Claims, 4 Drawing Sheets

(52) U.S. Cl.
CPC ..... *H04R 1/1083* (2013.01); *H04R 25/656* (2013.01); *H04R 29/00* (2013.01)

(58) Field of Classification Search
USPC ..... 381/322, 328, 329, 380; 128/864, 865; 600/301
See application file for complete search history.

(56) References Cited

U.S. PATENT DOCUMENTS

2006/0098833 A1* 5/2006 Juneau ..... H04R 25/656 381/328
2009/0069645 A1* 3/2009 Nielsen ..... A61B 5/02 600/301
2009/0245530 A1* 10/2009 Keady ..... A61F 11/08 381/72
2010/0111340 A1* 5/2010 Miller ..... H04R 1/326 381/322
2010/0322454 A1* 12/2010 Ambrose ..... H04R 1/1016 381/380
2013/0101147 A1* 4/2013 Kraemer ..... H04R 1/1016 381/322
2013/0136285 A1* 5/2013 Naumann ..... H04R 1/1016 381/329
2013/0202141 A1* 8/2013 Basseas ..... H04R 25/652 381/328
2013/0251172 A1* 9/2013 Mosseri ..... H04R 1/10 381/74
2014/0119585 A1* 5/2014 van Hal ..... H04R 25/652 381/330
2014/0146989 A1* 5/2014 Goldstein ..... A61F 11/08 381/380
2016/0008176 A1* 1/2016 Goldstein ..... A61F 11/08 128/864
2016/0015568 A1* 1/2016 Keady ..... A61F 11/10 128/865
2016/0050483 A1* 2/2016 Kulavik ..... H04R 1/1041 381/380

* cited by examiner

EARPHONES WITH MOTION SENSITIVE INFLATION

CLAIM OF PRIORITY

This patent application claims priority to and benefit from the U.S. Provisional Patent Application Ser. No. 62/037,847, filed Aug. 15, 2014. The above identified application is hereby incorporated herein by reference in its entirety.

TECHNICAL FIELD

Aspects of the present application relate to audio systems. More specifically, to methods and systems for earphones with motion sensitive inflation.

BACKGROUND

Limitations and disadvantages of conventional approaches to audio output devices, particularly earphones, will become apparent to one of skill in the art, through comparison of such approaches with some aspects of the present method and system set forth in the remainder of this disclosure with reference to the drawings.

BRIEF SUMMARY

Methods and systems are provided for earphones with motion sensitive inflation, substantially as illustrated by and/or described in connection with at least one of the figures, as set forth more completely in the claims.

DETAILED DESCRIPTION

As utilized herein the terms "circuits" and "circuitry" refer to physical electronic components (e.g., hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. In other words, "x and/or y" means "one or both of x and y." As another example, "x, y, and/or z" means any element of the seven-element set {(x), (y), (z), (x, y), (x, z), (y, z), (x, y, z)}. In other words, "x, y and/or z" means "one or more of x, y, and z." As utilized herein, the term "exemplary" means serving as a non-limiting example, instance, or illustration. As utilized herein, the terms "for example" and "e.g." set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled or not enabled (e.g., by a user-configurable setting, factory trim, etc.).

Figure 1:
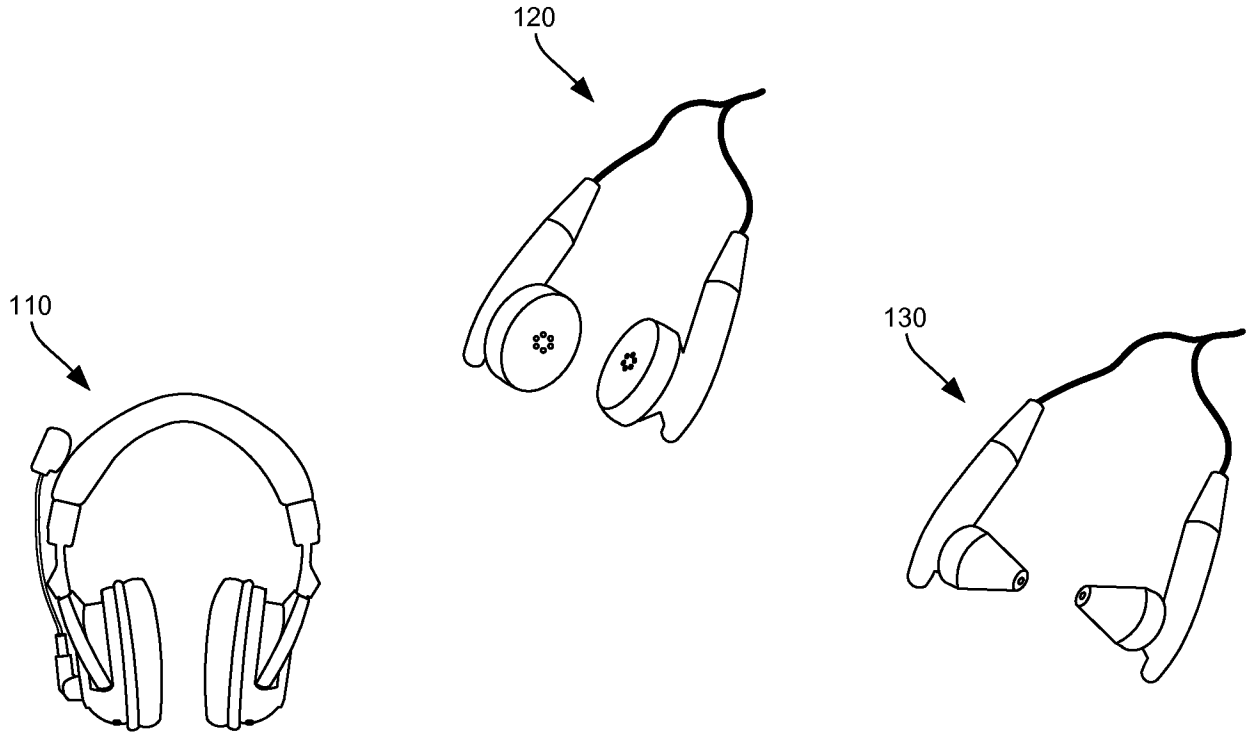
FIG. 1 illustrates various example earphones, which may be configured to implement various aspect of the present disclosure.

FIG. 1 illustrates various example earphones, which may be configured to implement various aspect of the present disclosure. Shown in FIG. 1 are various different example earphones 110, 120, and 130.

In this regard, "earphones" may comprise any suitable audio (or acoustic) output device which may be used in a manner by which audio (or acoustic) signals are outputted directly into users' ears. For example, earphones may comprise headphones (or headsets), such as headphone 110, in which the audio output components may rest on the users' ears (e.g., by incorporating circular or ellipsoid earpads that encompass the ears) or over the users' ears (e.g., by incorporating earpads that press against the ears). Earphones may also comprise ear-fitting headphones, in which the audio output components may rest directly against and/or within the users' ears. Examples of ear-fitting headphones may comprise earbuds, such as earbud 120, in which the audio output elements are fitted directly in the user's outer ear where they are facing but not inserted into the ear canals; and in-ear headphones, such as in-ear monitor 130, in which the audio output elements are inserted into the ear canals.

In some instances, the listening experience of the user when using earphones may be affected by, among various factors, the positioning of the earphones and the security of the earphones themselves against the user's ears. For example, in instances where the user may be moving (e.g., running, walking, etc.), the earphones may separate from the user's ears, and at the very least, the earphones may move even slightly creating a space between the earphone and the intended application area of the area. This may impact the listening experience. For example, such separation may expose the user's ears to ambient noise, which may interfere with the intended audio (or other acoustics) being outputted via the earphones.

Accordingly, in various implementations in accordance with the present disclosure, earphones (or any audio/acoustic outputting devices that may be operate by application of audio/acoustic signals directly into users' ears) may be configured to periodically or constantly adjust their positioning against the users' ears to guard against unintended or undesirable changes to that positioning. Securing and/or adjusting the positioning of the earphones may be determined based on, and/or may be intended to counteract, unintended or undesirable changes caused by the user's motion. In some example implementations, securing and/or adjusting the positioning of the earphones may be achieved by incorporating suitable means, such as inflatable elements. In this regard, the inflations of such inflatable elements may be dynamically and/or adaptively adjusted—e.g., based on movement of the user—to ensure optimal securing of the earphone onto or in the user's ears and/or an optimal seal between the earphone and the ears, thus minimizing effects of potential interference (e.g., ambient noise). An example implementation is described in more detail with respect to FIG. 2.

Figure 2:
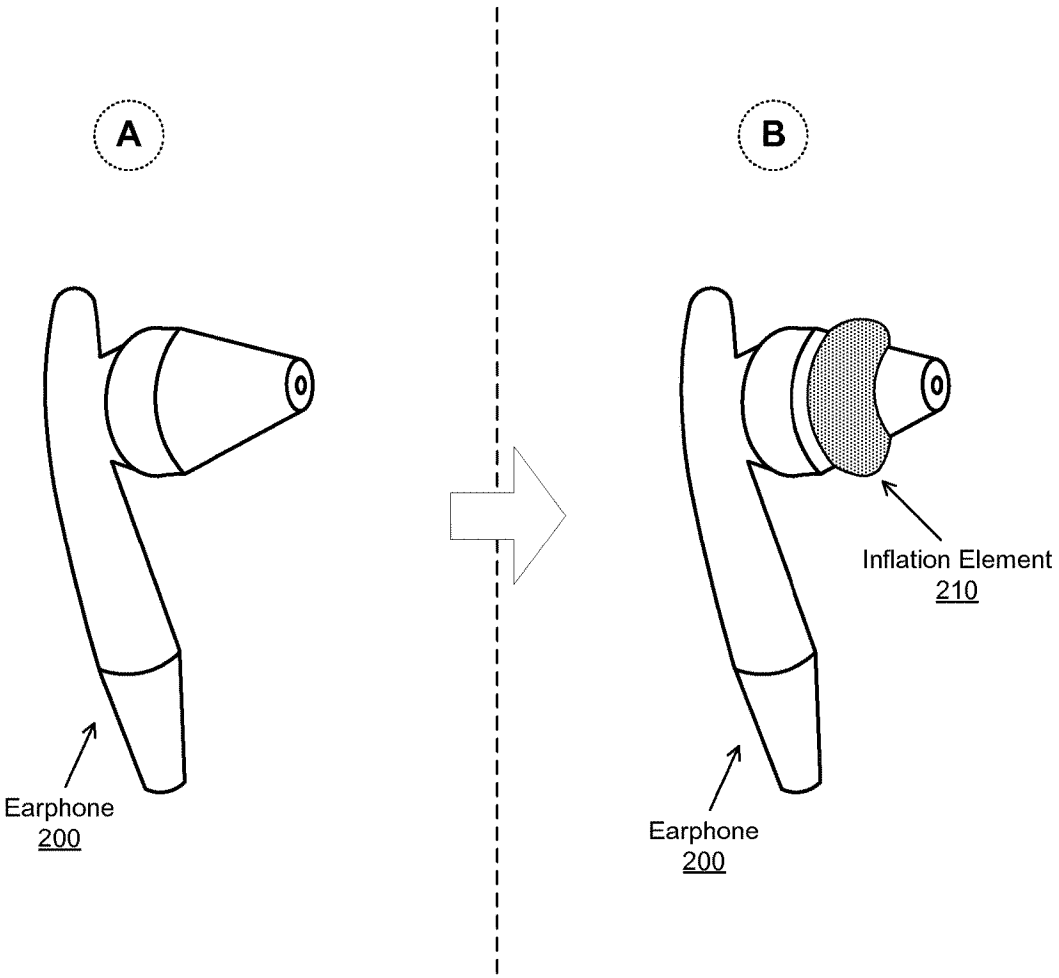
FIG. 2 illustrates an example use scenario of an earphone that is configured to support motion sensitive inflation, in accordance with the present disclosure.

FIG. 2 illustrates an example use scenario of an earphone that is configured to support motion sensitive inflation, in accordance with the present disclosure. Shown in FIG. 2 is an earphone 200.

The earphone 200 may be similar to any of the earphones shown in FIG. 1, for example. The earphone 200 may be configured to support motion sensitive inflation. For example, earphone 200 may comprise an inflation component 210, the inflation of which may be adaptively and/or dynamically controlled or adjusted based on, for example, movement of the user wearing the earphone 200. The inflation component 210 may comprise, for example, an air bladder which may inflate (as needed) to secure the earphone 200 into the user's ear (in which the earphone is inserted).

The inflation component 210 may be inflated in response to movement of the user (e.g., movement resulting from user walking or running). Further, in the inflation component 210 may be deflated in response to movement of the user. For example, the inflation component 210 may be inflated by a pump (not shown) or the like. In this regard, the pump may be configured to operate in response to movement of the user. Thus, when an increase in the movement of the user is detected or sensed, the pump may inflate the inflation component 210. The inflation component 210 may be deflated, such as by allowing air to slowly escape (e.g., through the pump or a release valve), in response to movement of the user—e.g., when there is reduction in the movement of the user.

Thus, the inflation of the inflation component 210 may be proportional to the amount of movement of the user (e.g., amount and/or type of movement). Adaptively adjusting the inflation in that manner—that is, based on the movement of the user—may be desirable because the likelihood of the earphones falling out increases with movement of the user. On the other hand, the pressure associated with increased inflation of the inflation component 210 may cause discomfort to the user over extended periods of time. Thus, when there is no (or little movement) and as such less likelihood of the earphones falling, deflating the inflation component 210 may relieve that discomfort.

In some instances, the inflation component 210 may be continually inflated, and the additional air may force out old air, thus keeping the earphone 200 and ear canal cool. Accordingly, the inflation component 210 may be configured to allow some air to escape even in inflated stated.

In some instances, the earphones may allow adjustment of the inflation based on other inputs beside the movement of the user. For the example, the earphone 200 (or any device coupled thereto) may also comprise a control (e.g., button) for manually pumping the inflation component 210 when not moving, and/or control (e.g., button or valve) for adjusting the degree of inflation (e.g., psi setting) of the inflation component 210—e.g., by controlling air leakage rate or bleeding off some air.

Figure 3:
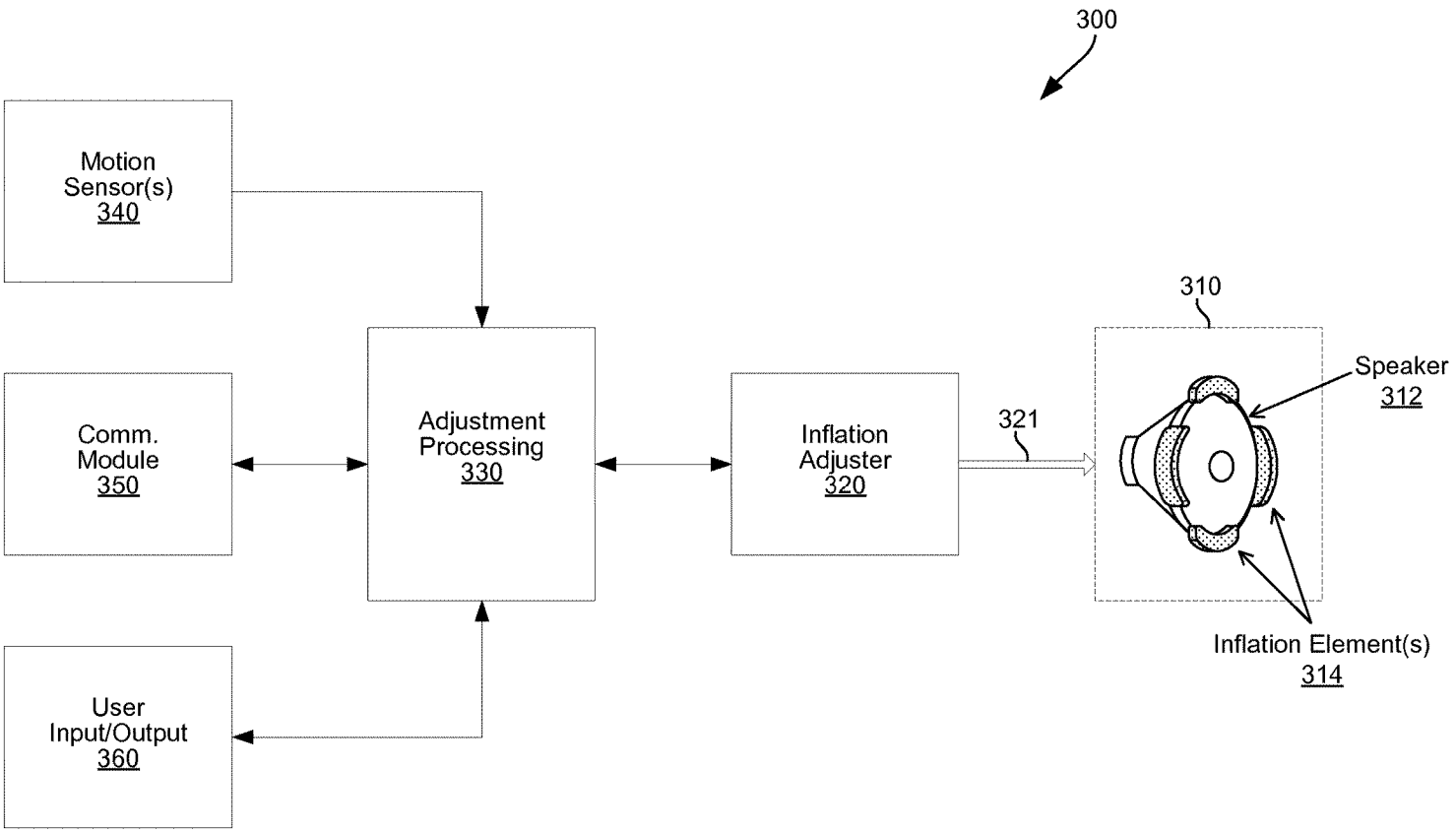
FIG. 3 illustrates an example system for supporting motion sensitive inflation in earphones, in accordance with the present disclosure.

FIG. 3 illustrates an example system for supporting motion sensitive inflation in earphones, in accordance with the present disclosure. Shown in FIG. 3 is system 300.

The system 300 may comprise an earphone 310 and suitable circuitry and/or other hardware, which may be configured for supporting motion sensitive inflation in the earphone 310. In this regard, the earphone 310 may comprise, for example, one or more inflation elements 314 attached to the speaker element 312 of the earphone 310. The one or more inflation element 314 may be used to ensure secured and/or sealed of the earphone 310 (or the speaker element 312 thereof) onto or in the user's ear.

For example, the system 300 may comprise, for example, an inflation adjuster 320, an adjustment processing block 330, one or more motion sensors 340, a communication module 350, and a user input/output (I/O) component 360.

The inflation adjuster 320 may be adapted to adjust the inflation of the one or more inflation elements. For example, the inflation adjuster 320 may comprise a pump, a valve, and/or corresponding suitable circuitry and/or hardware for inflating the one or more inflation elements 314, such as by generating air stream 321 that may be applied into them, and/or for deflating the one or more inflation element 314, such as by releasing some of the air already in the inflation elements 314.

The adjustment processing block 330 may comprise suitable circuitry for determining inflation adjustments. For example, the adjustment processing block 330 may determine when and/or how (amount) to adjust the inflation. In this regard, the adjustment processing block 330 may determine the proper adjustments (e.g., in terms of timing and/or degree) based on various inputs received from other components of the system 300—e.g., current inflation of the elements (obtained from the inflation adjuster 320), sensory information relating to the motion of the user (e.g., obtained from the motion sensors 340), and/or user preferences (e.g., obtained via the user I/O component 360).

The motion sensors 340 may comprise suitable circuitry and/or hardware for detecting motion (e.g., movement of the user wearing the earphone 310) and/or information relating to that motion (e.g., degree, type, etc.).

The motion sensors 340 may comprise, for example, a gyroscope, an accelerometer, and/or a compass suitable circuitry and/or hardware for detecting motion (e.g., movement of the user wearing the earphone 310) and/or information relating to that motion (e.g., degree, type, etc.). For example, the motion sensors 340 may comprise a gyroscope, an accelerometer, and/or a compass The communication module 350 comprise suitable circuitry and/or hardware for supporting communication (e.g., wired and/or wireless), particularly with respect to operations of the system 300.

The user I/O component 360 may comprise suitable circuitry and/or hardware for enable user interactions (input and/or output), particularly with respect to operations of the system 300. For example, the user I/O component 360 may enable user input and/or output relating to inflation (or adjustment thereof) of the inflation elements 314. The user I/O component 360 may support various types of input and/or output, including audible, graphical, textual, etc.

In some instances, all of the components of the system 300 may be incorporated into the earphone 310. Alternatively, in some instances, at least some of the components of the system 300 may be external to the earphone 310, being incorporated into a device coupled to the earphone 310 for example—e.g., the device providing the audio/acoustics being outputted via the earphone 310 (e.g., a device such as a smartphone, tablet device, music player, etc.). For example, in one embodiment, the earphone 310 may take advantage of motion sensor(s) (devices, MEMS, chips, circuitry, etc., implementing for example, a gyroscope, an accelerometer, and/or a compass) that exist in the device providing the audio/acoustics being outputted via the earphone 310. In this example embodiment, signals from the motion sensor(s) are communicated to the earphone 310 related to motion of the device providing the audio/acoustics being outputted via the earphone 310 (and thus related to the user).

Other components may also be located externally to the earphone 310 such as, for example, the inflation adjuster 320—thus, air being used to inflate the inflation elements 314 may be transported via suitable pipe, tube, or the like to the earphone 310.

While FIG. 3 depicts an electronically controlled inflation adjuster, in another implementation the pump may operate purely mechanically on the force generated by the movement of the wearer. For example, a piston in a vertical cylinder may be move up and down, pumping air into the inflation element(s) 310, in response to the wearer's strides.

Figure 4:
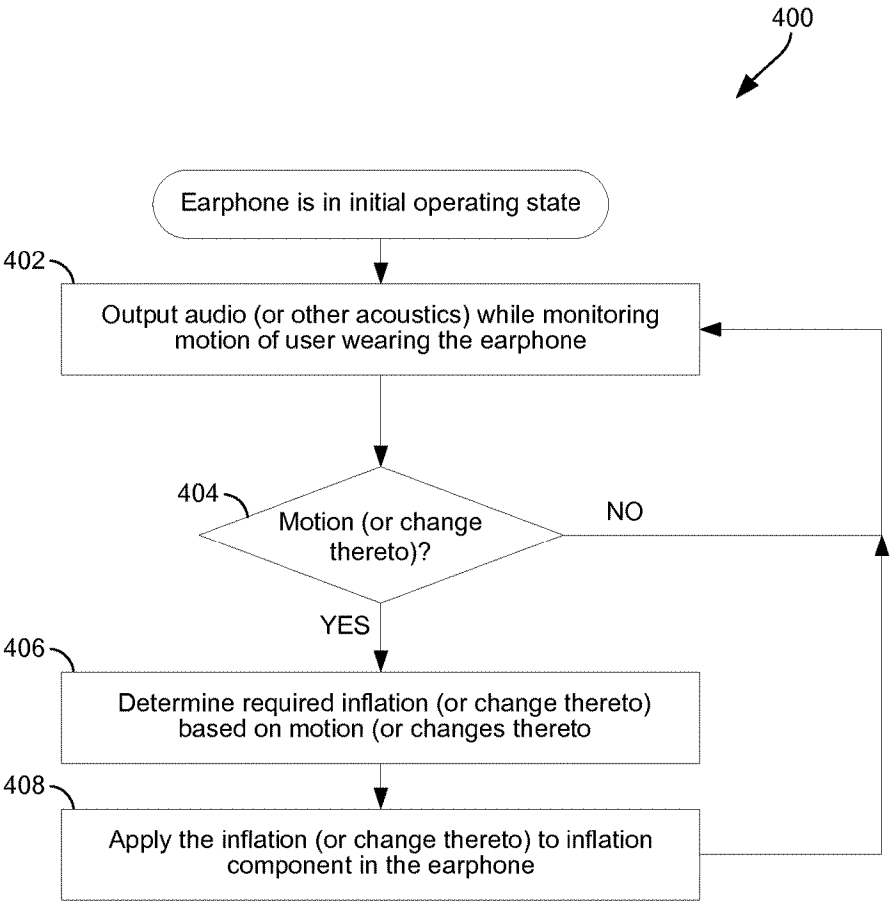
FIG. 4 is a flowchart illustrating an example process for providing motion sensitive inflation in earphones.

FIG. 4 is a flowchart illustrating an example process for providing motion sensitive inflation in earphones. Shown in FIG. 4 is a flow chart 400, comprising a plurality of example steps.

In step 402, audio (or other acoustics) is output while motion of user wearing the earphone is monitored.

In step 404, it may be determined if there has been movement (or change thereto) by the user of the earphone. In instances where there has been no movement (or change thereto), the process may loop back to step 402, to continue audio/acoustic output operations.

Returning to step 404, in instances where there has been movement (or change thereto), the process may proceed to step 406. In step 406, the required inflation (or change thereto) may be determined, such as based on motion (or changes thereto) or other factors (e.g., user preferences, current inflation, etc.).

In step 408, the inflation (or change thereto) as determined in the previous step may be applied to an inflation component in the earphone. The process may then loop back to step 402, to continue audio/acoustic output operations.

The present method and/or system may be realized in hardware, software, or a combination of hardware and software. The present methods and/or systems may be realized in a centralized fashion in at least one computing system, or in a distributed fashion where different elements are spread across several interconnected computing systems. Any kind of computing system or other apparatus adapted for carrying out the methods described herein is suited. A typical combination of hardware and software may be a general-purpose computing system with a program or other code that, when being loaded and executed, controls the computing system such that it carries out the methods described herein. Another typical implementation may comprise an application specific integrated circuit or chip. Some implementations may comprise a non-transitory machine-readable (e.g., computer readable) medium (e.g., FLASH drive, optical disk, magnetic storage disk, or the like) having stored thereon one or more lines of code executable by a machine, thereby causing the machine to perform processes as described herein.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. Therefore, it is intended that the present method and/or system not be limited to the particular implementations disclosed, but that the present method and/or system will include all implementations falling within the scope of the appended claims.

What is claimed:

1. A method comprising: in an audio system that comprises an audio output element operable to output audio signals, wherein at least a portion of said audio output element is applied directly to or is in contact with at least a portion of an ear of a user of said audio system: obtain information relating to movement of said user;

determining based on said obtained information, one or more adjustments to positioning of said at least a portion of said audio output element relative to said ear of said user, wherein said one or more adjustments are determined to account for or counteract effects of said movement of the user on one or both of said outputting of said audio signals and said contact between said audio output element and said at least a portion of said ear of said user; and applying said determined one or more adjustments.

2. The method of claim 1, wherein said audio output element comprises one or more of: headphone, headset, in-ear headphone, and earbud.

3. The method of claim 1, comprising performing one or both of said determination and application of said one or more adjustments in response to one or both of a particular trigger and user input.

4. The method of claim 1, wherein applying said determined one or more adjustment comprises modifying characteristics of one or more positioning components of or coupled to said audio output element.

5. The method of claim 4, wherein said one or more positioning components comprise at least one inflation component.

6. The method of claim 5, wherein said characteristics comprise inflation, and comprising modifying inflation of said at least one inflation component to affect said contact with said one ear of said user.

7. The method of claim 5, comprising injecting air into and releasing air from said at least one inflation component, and modifying inflation of said at least one inflation component by adjusting one or more both of said injecting and releasing.

8. The method of claim 1, comprising determining said one or more adjustments based on additional information, wherein said additional information comprises or is determined based on one or more of: user input, user preferences, and one or more characteristics associated with a component of said audio output element that is used in controlling said contact.

9. A system comprising:

an audio output element that is operable to output audio signals, wherein during operation, at least a portion of said audio output element is applied directly to or is in contact with at least a portion of an ear of a user of said system; and at least one circuit that is operable to:

obtain information relating to movement of said user; and determine based on said obtained information, one or more adjustments to positioning of said at least a portion of said audio output element relative to said ear of said user, wherein said one or more adjustments are determined to account for or counteract effects of said movement of said user on one or both of said outputting of said audio signals and said contact between said audio output element and said at least a portion of said ear of said user; and one or more positioning elements that are operable to apply said determined one or more adjustments.

10. The system of claim 9, wherein said audio output element comprises one or more of: headphone, headset, in-ear headphone, and earbud.

11. The system of claim 9, wherein one or both of said determining of said one or more adjustments by said at least one circuit and said applying of said one or more adjustments by said one or more positioning elements is performed in response to one or both of a particular trigger and user input.

12. The system of claim 9, wherein said one or more positioning elements are operable to apply said one or more adjustments based on characteristics associated with said one or more positioning elements.

13. The system of claim 9, wherein said one or more positioning elements comprise at least one inflation component.

14. The system of claim 13, comprising an inflation adjuster that is operable to adjust inflating of said at least one inflation component.

15. The system of claim 13, wherein said at least one inflation component is operable to apply said determined one or more adjustments based on modifying of inflation of said at least one inflation component.

16. The system of claim 15, wherein said at least one inflation component is operable to enable continual injection and releasing of air, and said modifying of inflation of said at least one inflation component comprises adjusting one or both of said injecting and releasing.

17. The system of claim 9, wherein said at least one circuit determines said one or more adjustments based on additional information, wherein said additional information comprises or is determined based on one or more of: user input, user preferences, and one or more characteristics associated with a component of said audio output element that is used in controlling said contact.

18. An earphone that is applied directly to or is in contact with at least a portion of an ear of a user, comprising:

an audio output element that is operable to output audio signals; and one or more inflation elements that are operable to apply one or more positioning adjustments, wherein:

said one or more positioning adjustments affect positioning of at least portion of said earphone relative to said at least a portion of said ear of said user;

said one or more positioning adjustments are determined based on information relating to movement of said user; and said one or more positioning adjustments are determined to account for or counteract effects of said movement of said user on said outputting of said audio signals and/or said contact between said earphone and said at least a portion of said ear of said user.

19. The earphone of claim 18, wherein said one or more inflation elements that are operable to apply one or more positioning adjustment based on modifying of inflation of at least one of said one or more inflation elements.

20. The earphone of claim 18, wherein at least one of said one or more inflation elements is configured to enable injection and release of air.

21. The earphone of claim 18, wherein said earphone comprises one or more of: a headphone, a headset, an in-ear headphone, and an earbud.

22. The earphone of claim 18, wherein said one or more positioning adjustments are determined based on additional information that comprises or is based on one or more of: user input, user preferences, and one or more characteristics associated with a component of said audio output element that is used in controlling said contact.

* * * * *